US011198954B2

(12) United States Patent
Agrikli

(10) Patent No.: US 11,198,954 B2
(45) Date of Patent: Dec. 14, 2021

(54) YARN TWISTING MACHINE

(71) Applicant: AĞTEKS ÖRME VE TEKSTIL ENDÜSTRILERI SAN. VE TIC. LTD. ŞTI., Istanbul (TR)

(72) Inventor: Mehmet Agrikli, Istanbul (TR)

(73) Assignee: Ağteks Örme Ve Tekstil Endüstri leri San. Ve Tic. Ltd. Şti., Istanbul (TR)

( * ) Notice: Subject to any disclaimer, the term of this patent is extended or adjusted under 35 U.S.C. 154(b) by 47 days.

(21) Appl. No.: 16/636,217

(22) PCT Filed: Jul. 30, 2018

(86) PCT No.: PCT/TR2018/000070
§ 371 (c)(1),
(2) Date: Feb. 3, 2020

(87) PCT Pub. No.: WO2019/245469
PCT Pub. Date: Dec. 26, 2019

(65) Prior Publication Data

US 2020/0370207 A1 Nov. 26, 2020

(30) Foreign Application Priority Data

Aug. 11, 2017 (TR) ..... 2017/11927

(51) Int. Cl.
*D01H 1/10* (2006.01)

(52) U.S. Cl.
CPC ..... *D01H 1/10* (2013.01)

(58) Field of Classification Search
CPC ..... D01H 1/10; D01H 1/101; D01H 1/00; D01H 1/24; D01H 1/166
See application file for complete search history.

(56) References Cited

U.S. PATENT DOCUMENTS 3,834,146 A * 9/1974 Nessler ..... D01H 1/101 57/58.54
4,262,479 A * 4/1981 Lenorak ..... D01H 1/10 57/58.49

(Continued)

FOREIGN PATENT DOCUMENTS

CN 105671707 A 6/2016
DE 102006061290 A1 6/2008

(Continued)

*Primary Examiner* — Shaun R Hurley
*Assistant Examiner* — Patrick J. Lynch
(74) *Attorney, Agent, or Firm* — Akerman LLP

(57) ABSTRACT

A yarn twisting machine comprising a main shaft into which yarn or yarns are introduced and from which yarn or yarns are taken out and the main shaft being driven by a first motor; a lower twisting disc being in contact with yarn and yarns taken out of the main shaft; an upper twisting disc having an aperture through which the yarn or yarns creating a yarn balloon by advancing along the lower twisting disc are fed; an upper platform situated below said upper twisting disc; a winding element for winding the yarns or yarns passing through the upper twisting disc on a bobbin; a lower stationary table situated above the lower twisting disc; and a second motor for transmitting drive to the winding element through an axial magnetic coupling. The yarn twisting machine comprises a first power transfer device for rotating the upper twisting disc around the shaft axis.

13 Claims, 9 Drawing Sheets

(56) References Cited

U.S. PATENT DOCUMENTS

| | | | | |
|---|---|---|---|---|
| 4,304,091 | A * | 12/1981 | Ragan | D01H 1/00 57/100 |
| 4,642,980 | A | 2/1987 | Fukunaga et al. | |
| 6,425,236 | B1 | 7/2002 | Roquet et al. | |

FOREIGN PATENT DOCUMENTS

| | | | |
|---|---|---|---|
| WO | 2005/040465 | A1 | 5/2005 |
| WO | 2008/036055 | A2 | 3/2008 |

* cited by examiner

YARN TWISTING MACHINE

CROSS-REFERENCE TO RELATED APPLICATIONS

This application is a national phase of PCT/TR2018/000070, filed Jul. 30, 2018, and claims priority to TR 2017/11927, filed Aug. 11, 2017, the entire contents of both of which are hereby incorporated by reference.

TECHNICAL FIELD

Present invention relates to an improved version of yarn twisting machine which is described in Publication No. WO2008036055, especially relates to a yarn twisting machine comprising a convenient arrangement for twisting yarns, such as continuous filaments and technical yarns, being sensitive to friction, without any damages.

BACKGROUND OF THE INVENTION

WO2008036055 comprises a main shaft driven by a first motor and placed at the center of a twisting disc, the main shaft having an axial opening from which yarns to be twisted are fed through; a main lower drive ring driven by a second motor and housed coaxially and such that it will be at a lower side of the twisting disc; and an upper drive ring housed coaxially and such that it will be at an upper side of the twisting disc. The twisting disc is equipped with a non-magnetic material and lower drive ring below the twisting disc contains a number of magnets which are annularly provided. Similarly, upper drive ring above the twisting disc is provided with a number of annularly supplied magnets being aligned with the magnets on the lower drive ring but having opposite poles with respect to the magnets of the lower drive ring. Thus, according to WO2008036055, a magnetic coupling is formed between the lower drive ring and upper drive ring.

In WO2008036055, the power received from the second motor is transferred to the upper drive ring through the magnetic coupling, and then to a yarn winding drum, and to a yarn feeder housed on an upper platform being at the top of the machine through a belt-pulley mechanisms.

According to WO2008036055, the yarns to be twisted are fed through a hole formed along the shaft axis, and then passed through a hole opened radially to twisting disc. The yarns are further transferred to the yarn feeder on the upper platform so as to create a yarn balloon. Twisted yarn rubs against the circular sides of the upper stationary platform and the heat thus created may damage to it in accordance with the type of the yarn used. While the rubbing does not damage to for instance cotton yarns, it may cause continuous type filament yarns such as nylon, polypropylene, polyester, aramid to break due to the rubbing heat.

On the other hand, rubbing and temperature increases arising from it may become crucial if the yarn to be twisted is a technical yarn such as glass fiber, basalt, and carbon fiber. A similar situation would also apply to the yarn to be twisted when it is of any metal material (copper, silver, stainless steel, tungsten, etc.). In such a case, not only the rubbing of the yarn twisted in the similar way to the case in WO2008036055 to the circular sides of the upper platform, but also the friction arisen from the contact of the yarn to the driven yarn feeder becomes crucial. Because of the above reasons, WO2008036055 may pose some disadvantages for twisting continuous-type filament yarns and technical yarns.

DESCRIPTION OF THE INVENTION

The objective of the invention is to provide an efficient twisting for the yarns being sensitive to friction.

In order to achieve the objective, present invention relates to a yarn twisting machine comprising a main shaft into which yarn or yarns are introduced and from which yarn or yarns are taken out and the main shaft being driven by a first motor; a lower twisting disc being in contact with yarn and yarns taken out of the main shaft and said lower twisting disc being in communication with said main shaft; an upper twisting disc having an aperture through which the yarn or yarns creating a yarn balloon by advancing along the lower twisting disc are fed; an upper platform situated below said upper twisting disc; a winding element for winding the yarns or yarns passing through the upper twisting disc on a bobbin; a lower stationary table situated above the lower twisting disc; and a second motor for transmitting drive to the winding element through an axial magnetic coupling. The yarn twisting machine comprises a first power transfer device for rotating the upper twisting disc around the shaft axis, the first power transfer device being in communication with the first motor or the second motor and with the upper twisting disc.

According to the preferred embodiment of the invention, winding element is a winding drum, as disclosed in WO2008036055 and it is connected to a lower stationary table (so as to be above thereof). Said lower stationary table is kept stationary without pivoting by means of another axial magnetic coupling.

According to an embodiment of the invention, rotation of the upper twisting disc is provided by drive from the main shaft. Accordingly, a pulley located at the top end of the main shaft is associated with a pulley located on an upper twisting disc drive shaft extending vertically and spaced apart from the main shaft. A further pulley located at the top end of the upper twisting disc drive shaft is connected to a pulley attached to a yarn guide fixed on the upper twisting disc via another pulley. Therefore, drive from the main shaft provides the upper twisting disc to be rotated.

According to an embodiment of the invention, twisted yarn, before introduced into the upper twisting disc, is enabled to pass through a reel located above the upper twisting disc and freely rotating in the vertical axis in order to decrease the friction thereof.

According to an embodiment of the invention, the bobbin is rotated by means of the drive provided by the second motor via a second drive device and in such embodiment, the winding element providing the yarns to be wound on the bobbin is a traverse device which can axially move through a third drive device on a shaft rotatably housed on the upper platform and lower stationary table. In this configuration, yarn or yarns pass through reels having surfaces with too low friction coefficient, such as ceramic in separate locations from the feeding point to the winding element, according to the preferred embodiment. Thus, yarns are prevented to be exposed to axial and lateral frictions.

BRIEF DESCRIPTION OF DRAWINGS

The embodiment and the advantages of the present invention with additional components should be evaluated together with the figure described below in order to be best understood.

DESCRIPTION OF THE REFERENCE NUMERALS OF THE PARTS SHOWN IN DRAWINGS

Figure 1:
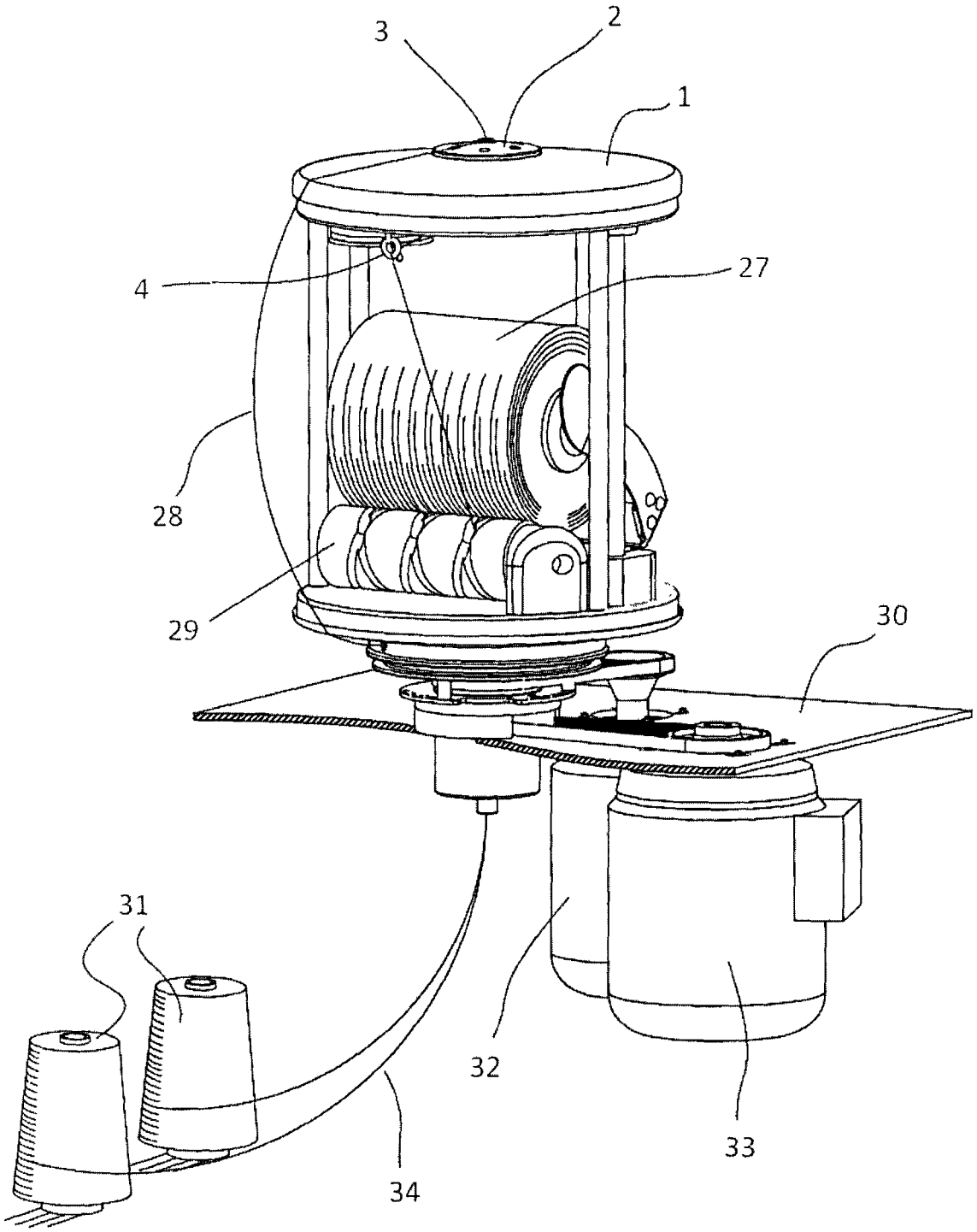
In FIG. 1, a perspective view of the yarn twisting machine is presented in accordance with the invention.

1 Upper twisting disc
2 Upper twisting disc lid
3 Upper twisting disc top aperture
4 Pigtail
5 Upper twisting disc centering pulley
6 Upper twisting disc shaft centering bearing carrier
7 Upper platform reel
8 Yarn feeder drive shaft upper housing
9 Yarn feeder drive shaft lower belt
10 Upper twisting disc drive lower pulley
11 Upper twisting disc drive lower belt
12 Upper twisting disc drive shaft lower bearing
13 Upper twisting disc drive shaft lower pulley
14 Upper twisting disc drive shaft
15 Upper twisting disc drive shaft upper bearing
16 Yarn feeder drive shaft lower housing
17 Upper twisting disc drive upper belt
18 Upper twisting disc drive shaft upper pulley
19 Upper twisting disc lower guide pulley
20 Upper tensioning pulley
21 Lower tensioning pulley
22 Rotating pin
23 Propeller yarn guide
24 Propeller reel
25 Guide lower aperture
26 Reel housing
27 Bobbin
28 Twisted yarn
29 Winding drum
30 Frame
31 Yarn bobbin
32 Second motor
33 First motor
34 Yarns to be twisted
35 feeder
36 Yarn feeder drive shaft
37 Upper platform
38 Yarn feeder drive shaft upper pulley
39 Yarn feeder drive shaft upper belt
40 Yarn feeder pulley
41 Main shaft
42 Yarn feeder lower belt
43 Yarn feeder drive shaft lower pulley
44 Upper rotating magnets
45 Upper stationary magnets
46 Lower stationary magnets
47 Lower rotating magnets
48 Second motor belt
49 First motor belt
50 Encoder
51 Twisting disc reel
52 Upper twisting disc side reel
53 Upper twisting disc upper reel
54 Upper platform reel
55 Lower twisting disc yarn outlet aperture
56 Lower twisting disc
57 Bobbin fixing rod
58 Bobbin fixing upper bearing
59 Bobbin fixing upper piece
60 Bobbin fixing lower piece
61 Bobbin rotating pulley
62 Bobbin rotating belt
63 Bobbin rotating lower pulley
64 Lower pulley housing
65 Bobbin rotating upper belt
66 Lower stationary magnetic ring
67 Connection bracket
68 Traverse pulley
69 Traverse shaft lower housing
70 Lower limit
71 Top limit
72 Reversing lever
73 Lower bearing
74 Traverse arrangement
75 Upper bearing
76 Traverse shaft
77 Traverse shaft upper housing
78 Yarn feeder lower intermediary pulley
79 Lower drive ring
80 Upper drive ring
81 Carrier disc
82 Upper stationary magnet ring
83 Lower stationary table
84 Stem

DETAILED DESCRIPTION OF THE INVENTION

Working principle of the yarn twisting machine of the invention is basically the same as described in WO2008036055. That is, a first motor, below the frame (30), rotating the main shaft (41) pivotably supported on the machine body and the lower twisting disc connected thereto transmits drive through the first motor belt (49); and a second motor (32) transmits drive, through a second motor belt (48), to the winding drum (29) moving the bobbin (27) on which twisted yarn is wound. Second motor (32) also transmits drive to a yarn feeder (35) which is connected to an upper platform (37) located on a top side of the yarn twisting machine.

Yarns to be twisted (34) which were unwound from a number of yarn bobbins (31) are fed to a hollow main shaft and transferred into the machine through the upper twisting disc top aperture (3) located on a top portion of the machine, by exiting through a lower twisting disc yarn outlet aperture (55) located in a carrier disc (81) below the lower twisting disc (56).

A lower stationary magnetic ring (66) secured on the body coaxially with main shaft (41) is provided and there is provided a number of lower stationary magnets (46) annularly therein. A lower drive ring (79) coaxially placed with the main shaft (41) is provided which is configured to rotate independently from the main shaft by means of rotating supports and there is a number of lower rotating magnets (47) annularly provided thereto.

There is provided a carrier disc (81) being coaxial with the main shaft (41) and rotating together therewith. The carrier disc is placed above the lower stationary magnets (46) and lower rotating magnets (47). The carrier disc (81) is made of a composite material, preferably not having electrical conductivity and magnetic property.

There is provided an upper drive ring (80) configured to rotate independently from the main shaft through rotatable supports and coaxially configured to the main shaft (41) above the carrier disc (81). The upper drive ring (80) contains a number of upper rotating magnets (44) annularly provided therein. The upper drive ring (80) can be rotated by a magnetic coupling formed between the upper rotating magnets (44) and oppositely poled lower rotating magnets (47) provided in the lower drive ring (79) driven by the second motor (32) through a belt (48).

There is provided an upper stationary magnetic ring (82) fixed to the body and coaxially arranged to the main shaft (41) above the carrier disc (81). The upper stationary magnetic ring (82) contains a number of upper stationary magnet (45) annularly provided therein. The upper stationary ring (82) is immovable as the lower stationary magnets (46) and oppositely poled upper stationary magnets (45) are aligned one another and the lower stationary magnetic ring (66) is fixed to the body. Since the upper stationary magnetic ring (82) is fixed to the lower stationary table (83) which supports the winding drum (29), it is enabled to be immovable as well.

There is provided an upper twisting disc drive lower pulley (10) at the top end of the main shaft (41) and it transmits the movement from the main shaft (41) to an upper twisting disc drive shaft lower pulley (13) through an upper twisting disc drive lower belt (11). An upper twisting disc drive shaft (14) is rotatably supported, from its lower end, by an upper twisting disc shaft lower housing (12) arranged at the lower stationary table (83), and from its upper end, by an upper twisting disc drive shaft upper housing (15) arranged at the upper platform (37). The upper twisting disc drive shaft lower pulley (13) receives the upper twisting disc drive shaft (14).

Figure 3:
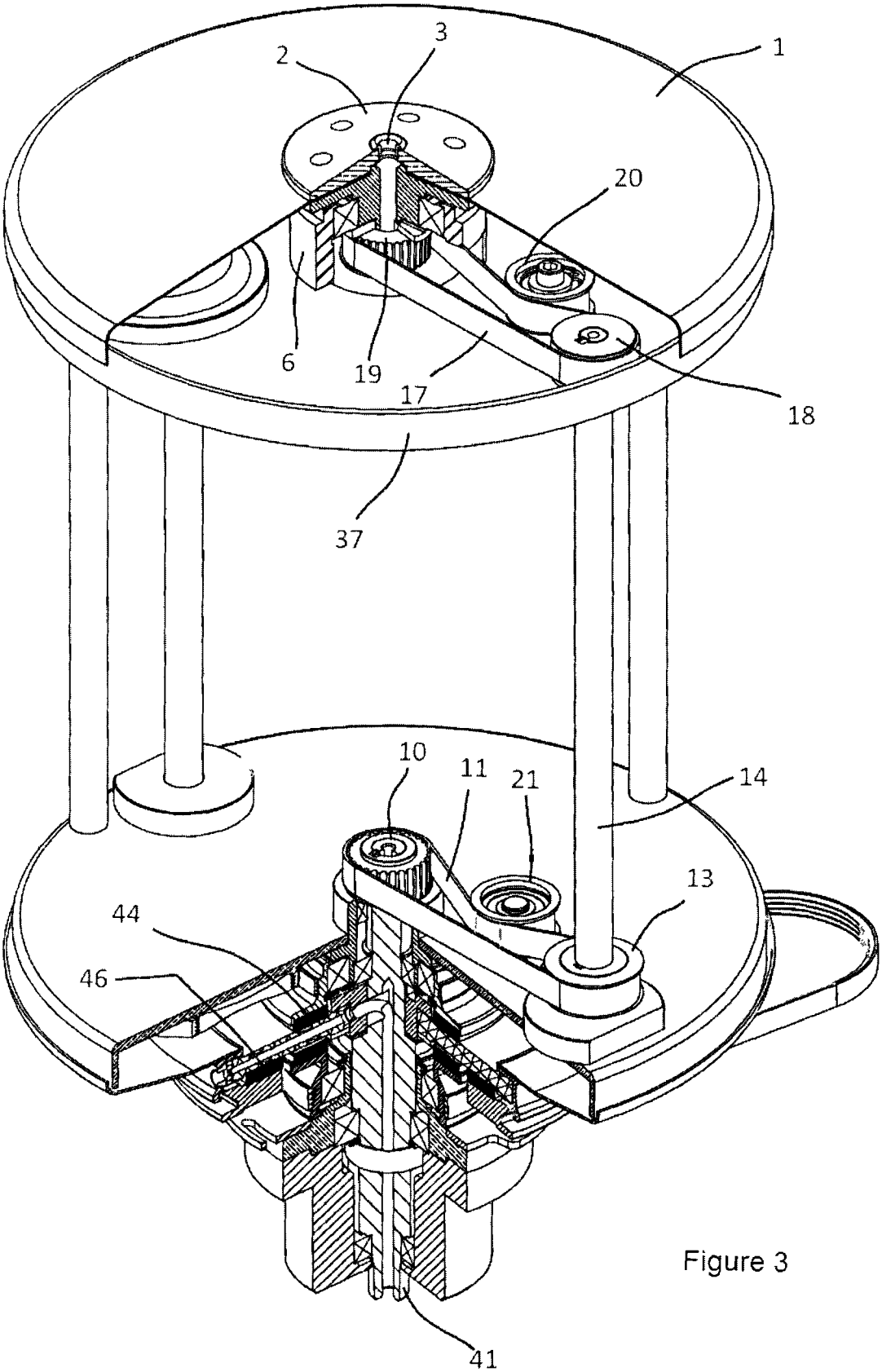
In FIG. 3, a top perspective cross-sectional view of the yarn twisting machine is presented in accordance with the invention.
Figure 4:
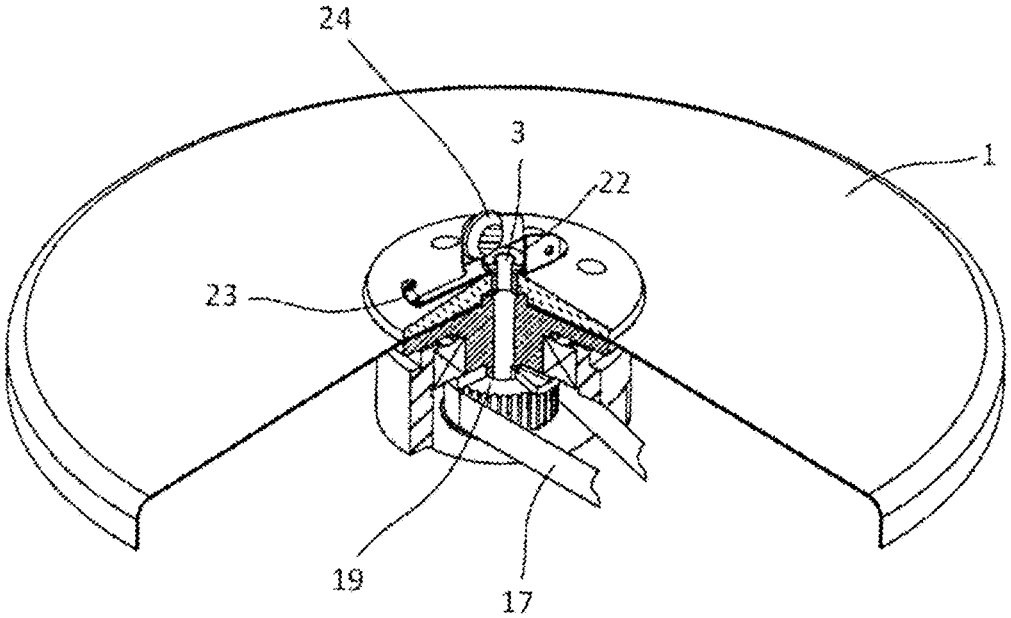
In FIG. 4, a perspective cross-sectional view of the upper twisting disc of the yarn twisting machine is presented in accordance with the invention.
Figure 5:
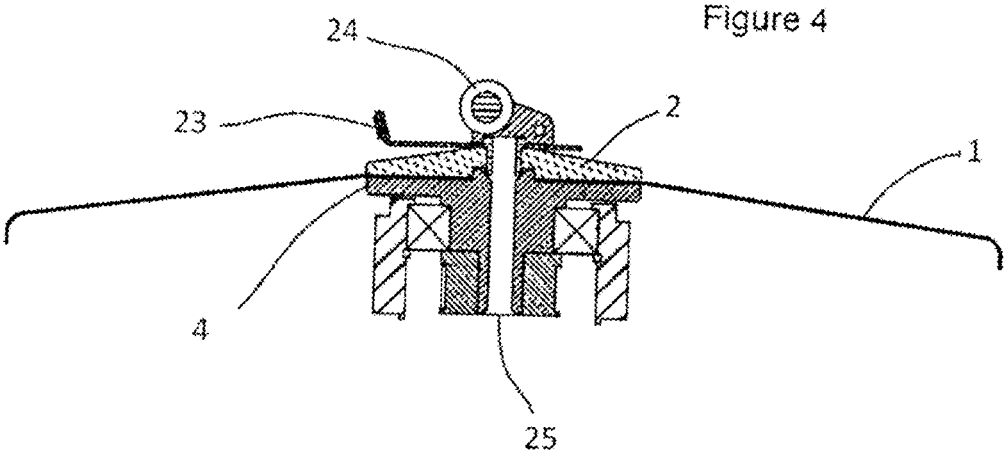
In FIG. 5, a cross-sectional view of the upper twisting disc of the yarn twisting machine is presented in accordance with the invention.

There is provided an upper twisting disc drive shaft upper pulley (18) at the top end of the upper twisting disc drive shaft (14) and it is in connection with an upper twisting disc lower guide pulley (19) through an upper twisting disc drive upper belt (17). Hence, the drive received from the upper twisting disc drive lower pulley (10) is transmitted to the upper twisting disc lower guide pulley (19). The upper twisting disc lower guide pulley (19) is rigidly attached to an upper twisting disc centering shaft (5) coaxially. The upper twisting disc centering shaft (5) is supported on an upper twisting disc shaft centering bearing carrier (6) which is secured onto the upper platform (37) by means of a rotatable support. There is an upper twisting disc lid (2) coaxially extending at a top portion of the upper twisting disc centering shaft (5) and a central portion of the upper twisting disc (1) is arranged therebetween. The upper twisting disc lid (2), upper twisting disc (1) and the upper twisting disc centering shaft (5) is attached to one another by means of connection means such as a vertically extending bolt. Hence, the upper twisting disc (1) can be rotated by means of the movement received from the upper twisting disc drive lower pulley (10). A lower tensioning pulley (21) and an upper tensioning pulley (20) may be used respectively in order to adjust the tensions of the upper twisting disc drive lower belt (11) and the upper twisting disc drive upper belt (17), as seen in FIG. 3.

There may be variations for rotating the upper twisting disc (1). For example, drive may be provided from the main shaft (41) such that the upper twisting disc drive pulley (10) will be below the lower stationary table (83). In this case, the upper twisting disc drive shaft (14) may be extended below the lower stationary table (83). In another embodiment, the required drive may be received from the second motor (32) by winding the upper twisting disc drive lower belt (11) around the upper drive ring (80). According to another embodiment, drive may be provided from the top portion close to the upper twisting disc (1) of the yarn feeder drive shaft (36) to be described below. In any case, the sizes of the pulleys transmitting drive for rotating the upper twisting disc (1) in an appropriate speed may be determined in any preferred way.

While the working principle of the yarn feeder (35) is basically as disclosed in WO2008036055, the position of said yarn feeder (35) has altered and moved to the lower portion of the upper platform (37) as the upper twisting disc (1) is rotated. This provided decrease in the energy loss that the machine requires due to the reduction of the yarn balloon relatively and rotating a lesser amount of yarn mass. The upper drive ring (80) rotated by the second motor (32) transmits its motion to a yarn feeder lower intermediary pulley (78) through a yarn feeder lower belt (42) and then the motion is further transferred therefrom to a yarn feeder drive shaft lower pulley (43) by means of a yarn feeder drive shaft lower belt (9). Yarn feeder drive shaft lower pulley (43) is attached to a yarn feeder drive shaft (36) from below. Said yarn feeder drive shaft (36) is supported at the lower stationary table (83) through a rotatable yarn feeder drive shaft lower support (16) from below and in the upper platform (37) through a rotatable yarn feeder drive shaft upper support (8) from above. There is a yarn feeder drive shaft upper pulley (38) at the top portion of the yarn feeder drive shaft (36) and said yarn feeder drive shaft upper belt (39) is attached to a yarn feeder pulley (40). A shaft extending downwardly from the middle of the yarn feeder pulley (40) is connected to the center of a cylindrical yarn feeder (35). Thus, the rotating motion from the upper drive ring (80) is transferred to the yarn feeder (35).

Twisted yarn (28) passing through the upper twisting disc top aperture (3) as seen in FIG. 1 extends downwardly from the opening formed between the upper twisting disc lid (2) and yarn lower guide (5); it is introduced into a yarn feeder (35) by winding it around an upper platform reel (7); and it is transmitted therefrom to the winding drum (29) having yarn guides on it by passing through a pigtail (4) attached to a lower portion of the upper platform (37). Winding drum rotates the bobbin (27) while it is rotating because the winding drum (29) is in physical contact with the bobbin (27), and thus twisted yarn is wound on the bobbin.

Figure 6:
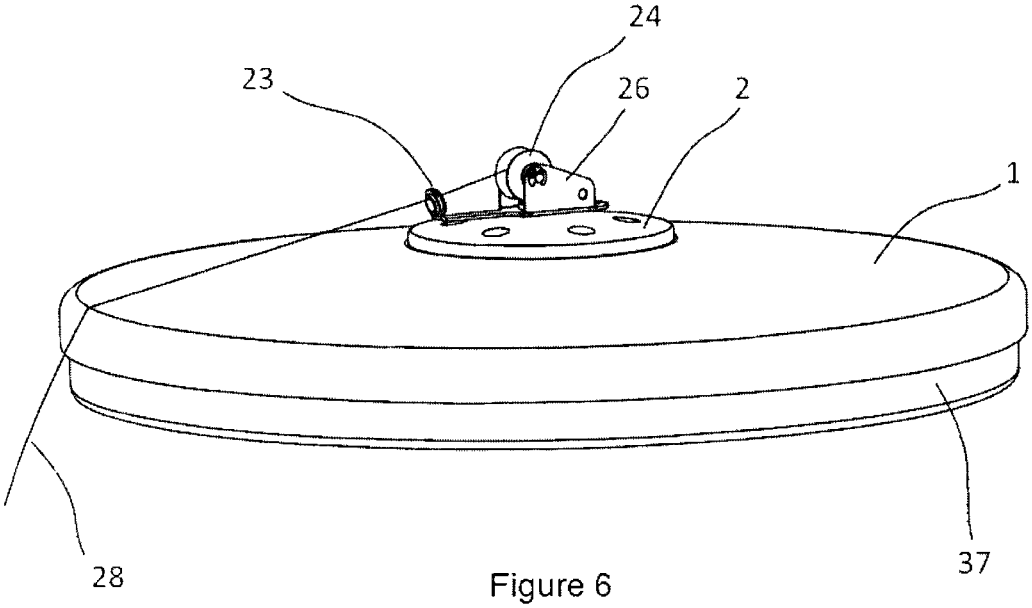
In FIG. 6, a perspective view of the upper twisting disc of the yarn twisting machine is presented in accordance with the invention.
Figure 7:
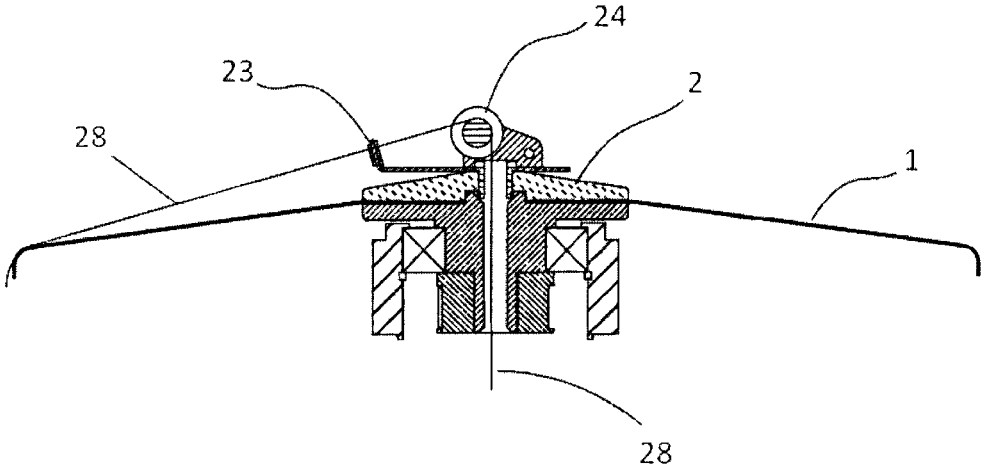
In FIG. 7, a cross-sectional view of the upper twisting disc of the yarn twisting machine is presented in accordance with the invention.

As seen in FIG. 4 to FIG. 7, a reel which can freely rotate like a "propeller" is disposed at the top portion of the upper twisting disc top aperture (3). Propeller reel (24) is supported in the reel housing (26) so as to rotate around its own axis, and reel housing (26) is supported by means of a rotating pin (22) disposed in the upper twisting disc top aperture (3). There is a propeller yarn guide (23) which is in contact with the reel housing (26) extending from the propeller reel (24) with a certain distance. As seen in FIG. 6 and FIG. 7, twisted yarn (28) advancing by contacting the edge of the upper twisting disc is wound on the propeller reel (24) after it passes through the propeller yarn guide (23), and it passes through the upper twisting disc top aperture (3) therefrom. Yarn friction is minimized across the upper twisting disc top aperture (3) by means of the free rotation of the propeller reel (24) in the vertical axis.

Figure 8:
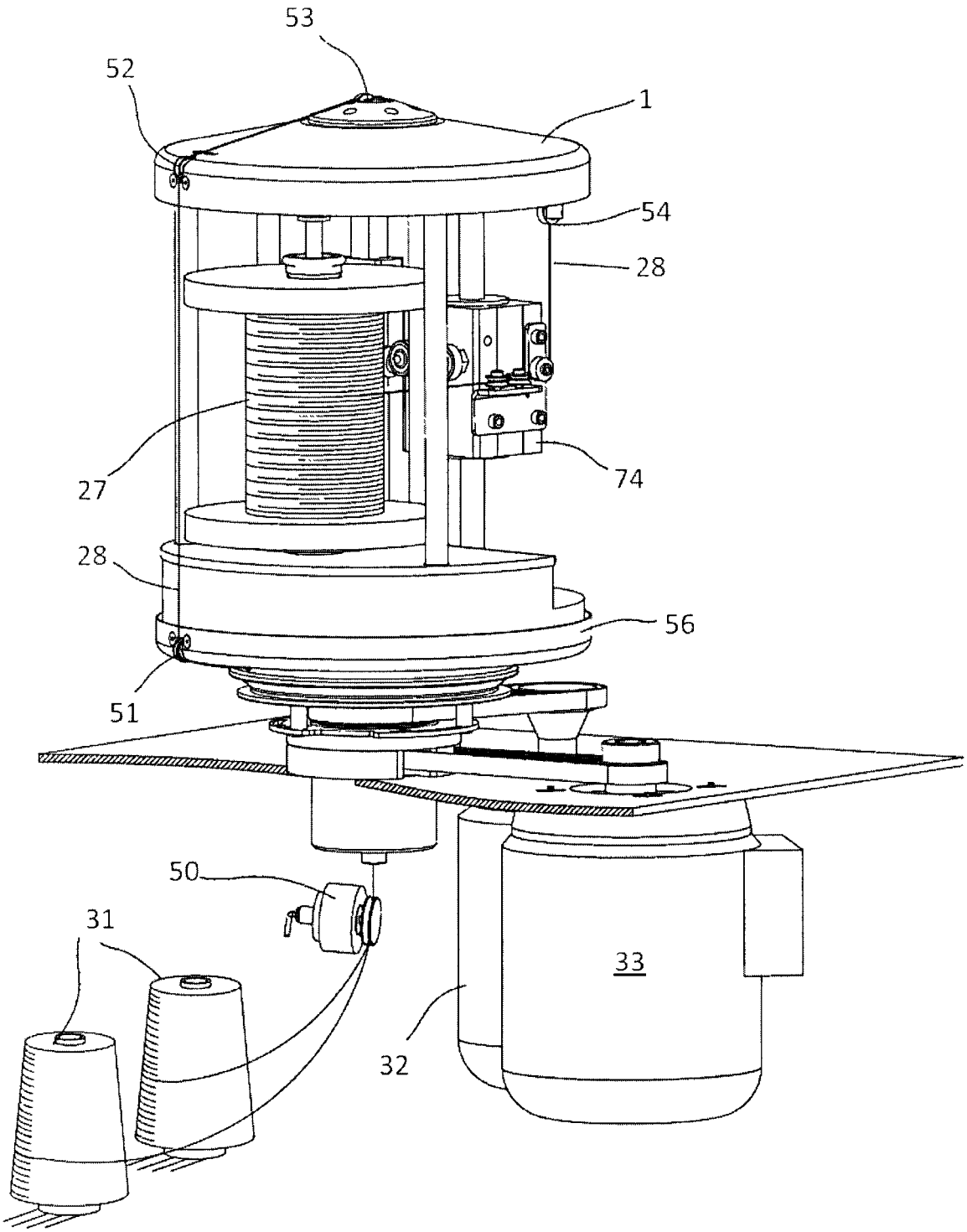
In FIG. 8, a perspective view of the yarn twisting machine is presented including another embodiment of the invention.

In FIG. 8, a perspective view of the yarn twisting machine is presented including a further embodiment of the invention. According to this embodiment, both lateral and axial yarn friction will be reduced further. In this embodiment, yarn feeder is preferably not used, and twisted yarn is wound on the driven bobbin by means of a traverse device.

The twisted yarn (28) exiting through the lower twisting disc outlet aperture (55) is transmitted to the upper twisting disc side reel (52) disposed at the circumference of the upper twisting disc (1) by passing through a twisting disc reel (51) disposed at the circumference of the lower twisting disc (56), and then to an upper twisting disc upper reel (53) disposed at a top portion of the upper twisting disc top aperture (3). The twisted yarn (28) exiting through the guide lower aperture (25) passes through another reel (not shown in figures) and sent to the traverse device (74) by also passing through the upper platform reel (54). Then, the twisted yarn (28) is passed through a number of reels on the traverse device (74) and wound on the bobbin (27).

Figure 9:
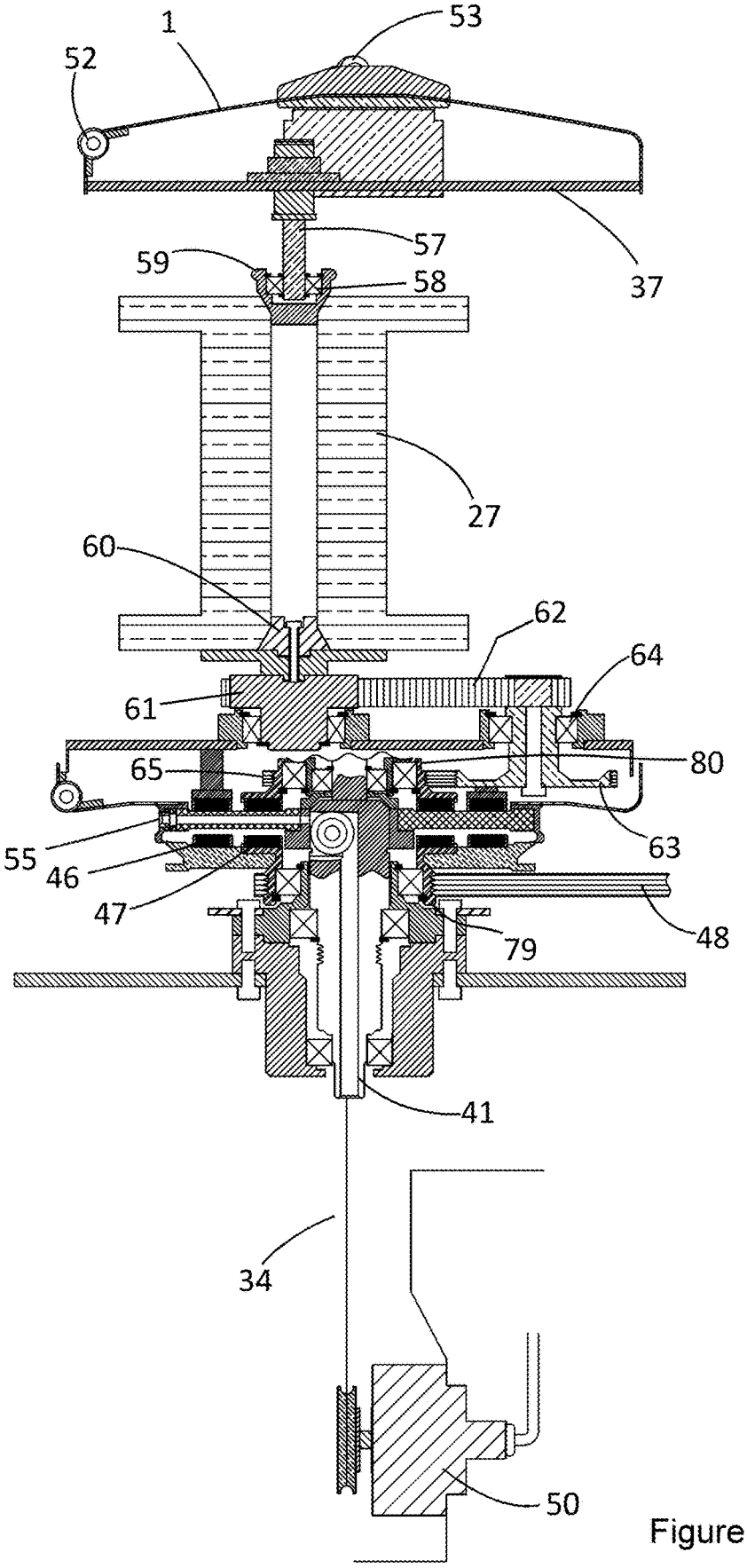
In FIG. 9, a cross-sectional view of the bobbin drive arrangement in the embodiment of FIG. 8 is presented.

In FIG. 9, a cross-sectional view of the bobbin drive arrangement is shown. The drive received from the lower drive ring (79) rotated by the second motor through magnetic coupling is transmitted to the upper drive ring (80), and then to a bobbin rotating lower pulley (63) rotatably supported by means of the lower pulley support (64), through a bobbin rotating upper belt (65). A bobbin rotating belt (62) connected to other (the upper) end of the bobbin rotating lower pulley (63) also transmits drive to the bobbin rotating pulley (61) disposed spaced apart from bobbin rotating lower pulley (63).

A bobbin fixing lower piece (60) fixed to a bobbin rotating pulley (61) is adapted to the axial opening of the bobbin (27) such that it is attached thereto. Thus, rotating motion received from the bobbin rotating pulley (61) is transmitted to the bobbin (27). The bobbin (27) is rotatably supported to the upper platform (37) from the other end portion (from the upper portion according to the figure). To achieve this, a bobbin fixing rod (57) secured at the upper platform (37) and extending downwardly therefrom is provided. The bobbin fixing rod (57) is supported by means of a rotating bobbin fixing upper bearing (58) located in the opening situated in the bobbin fixing upper piece (59).

According to an embodiment of the invention, bobbin winding rate may be controlled by an encoder (50). In accordance therewith, yarn(s) to be twisted which is fed below the main shaft (41) passes through an encoder (50). Such a control is especially provided for reducing the speed of the bobbin while twisted yarn amount increases thereon. The necessary motor control is provided by feeding the data about the yarn amount passing per unit of time supplied from the encoder to the second motor driver circuit.

Figure 2:
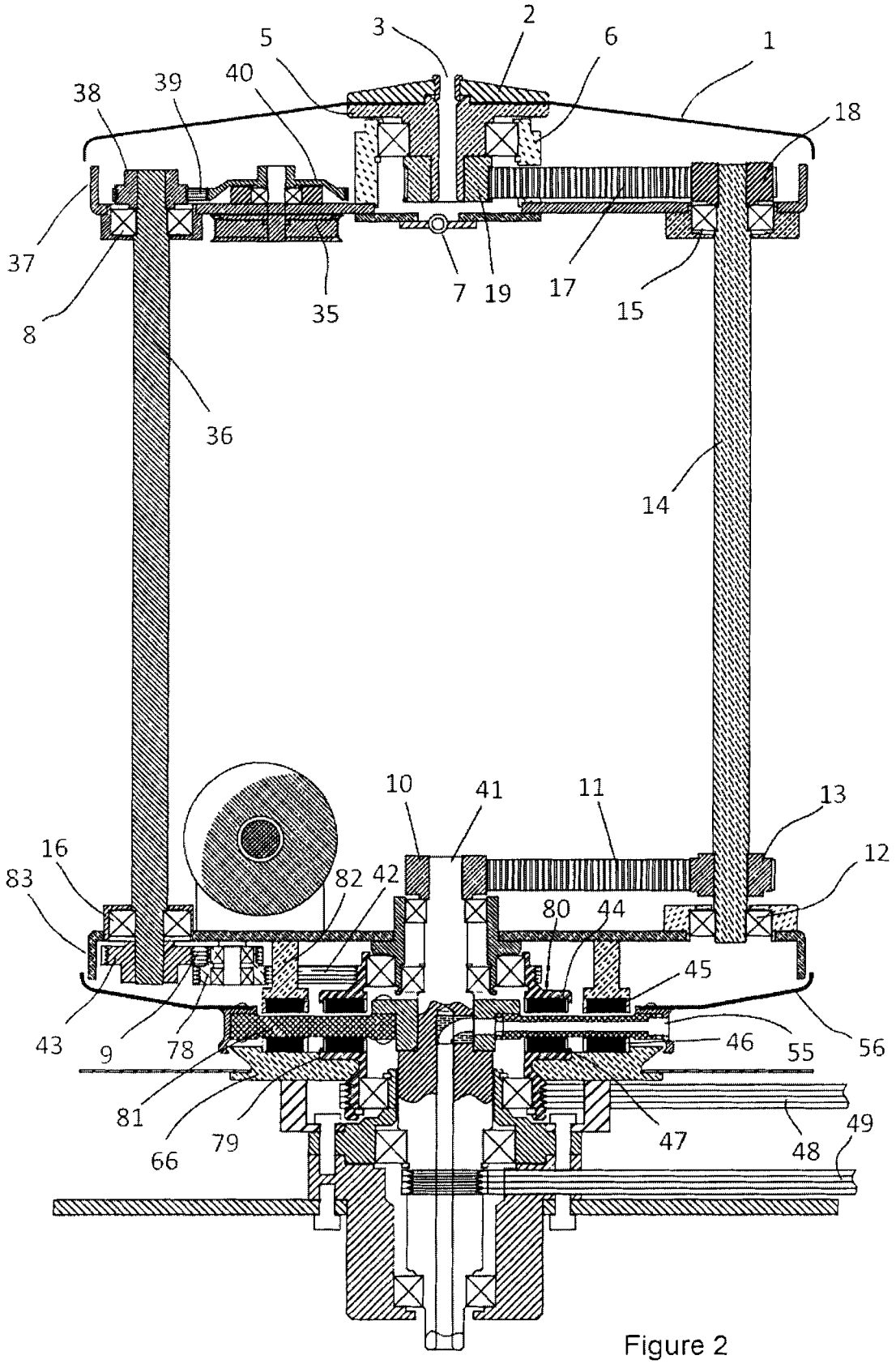
In FIG. 2, a longitudinal cross-sectional view of the yarn twisting machine is presented in accordance with the invention.
Figure 10:
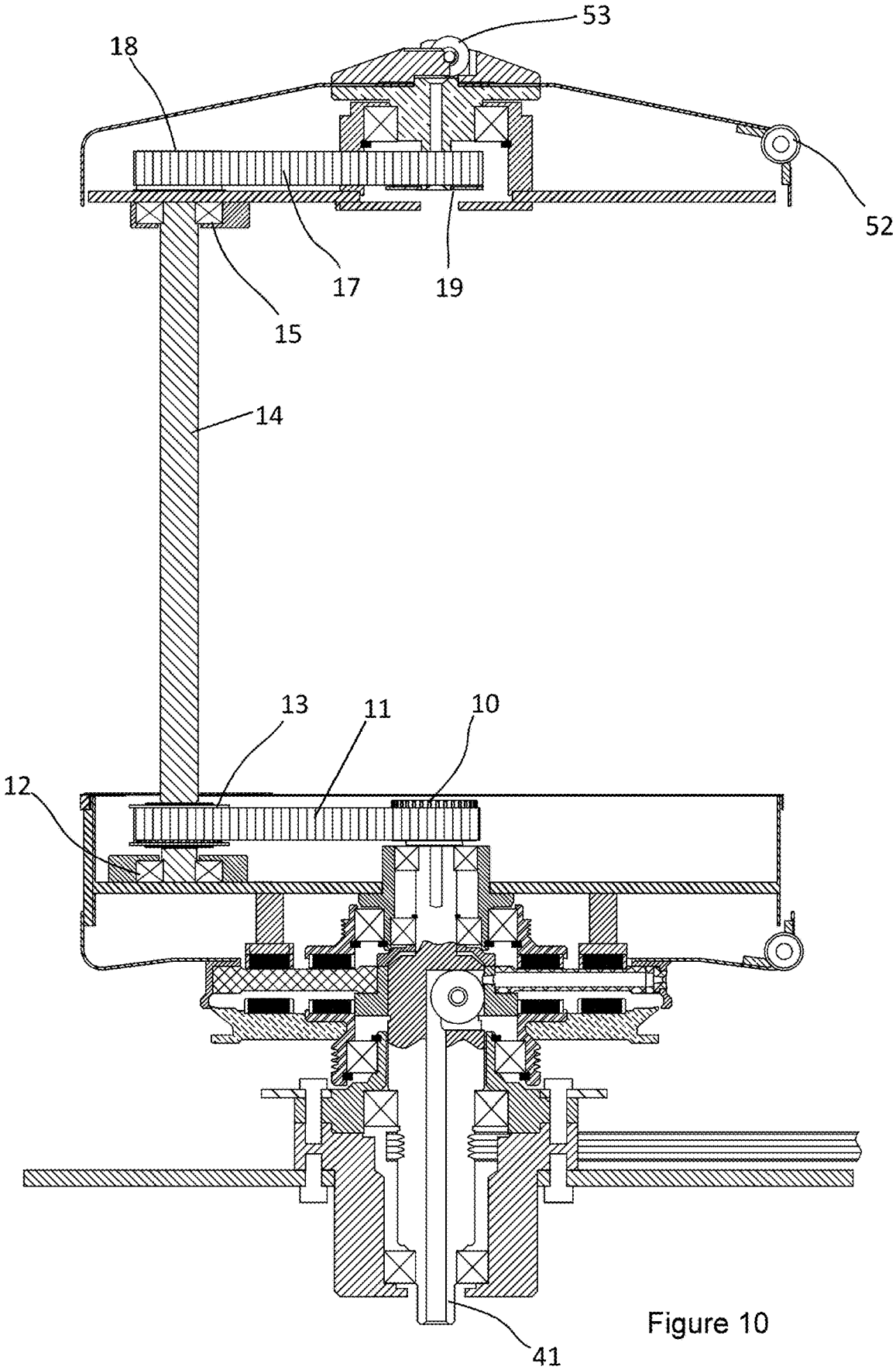
In FIG. 10, a cross-sectional view of the upper platform lid drive arrangement in the embodiment of FIG. 8.

In FIG. 10, a cross-sectional view of the upper platform lid drive arrangement is shown. In this embodiment, the drive mechanism of the upper platform lid is basically the same as the mechanism shown in FIG. 2. That is, the upper twisting disc drive lower pulley (10) at the top end of the main shaft (41) transmits its drive to an upper twisting disc drive shaft lower pulley (13) through an upper twisting disc drive lower belt (11). The upper twisting disc drive shaft lower support (13) engages to an upper twisting disc drive shaft (14) supported in the upper platform (37) through the rotating upper twisting disc drive shaft upper housing (15) from above; and to the lower stationary table (83) through a rotating upper twisting disc shaft lower support (12) from below the main shaft (41). The upper twisting disc drive shaft upper pulley (18) at the top end of the upper twisting disc drive shaft (14) is in connection with the upper twisting disc lower guide pulley (19) through the upper twisting disc drive upper belt (17). Hence, the drive received from the upper twisting disc drive lower pulley (10) is transmitted all the way to the upper twisting disc lower guide pulley (19). The upper twisting disc lower guide pulley (19) is rigidly attached to the upper twisting disc centering shaft (5) coaxially. There is provided an upper twisting disc lid (2) coaxially extending at a top portion of the upper twisting disc centering shaft (5) and a central portion of the upper twisting disc (1) is secured therebetween. The upper twisting disc lid (2), the upper twisting disc (1), and the yarn lower guide (5) are secure to one another. Hence, the upper twisting disc (1) can be rotated by means of the drive received from the upper twisting disc drive lower pulley (10).

Figure 11:
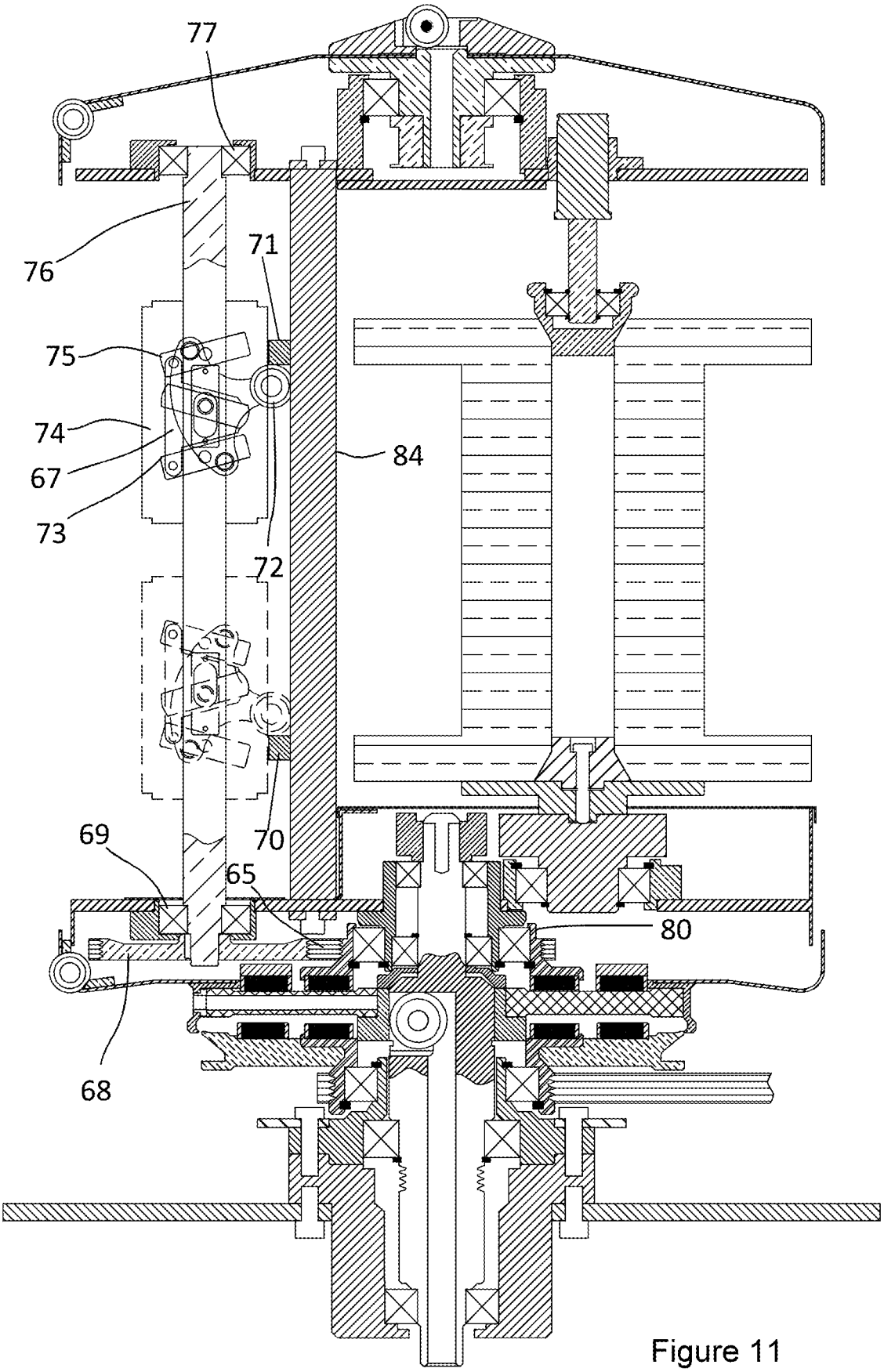
In FIG. 11, a cross-sectional view of the drive mechanism of the traverse arrangement providing twisted yarn in the embodiment of FIG. 8.

In FIG. 11, drive system of the traverse device supplying twisted yarn to the bobbin is shown. The drive received from the upper drive ring (80) is transmitted, through the bobbin rotating upper belt (65), to a traverse pulley (68) disposed below a traverse shaft (76) extending vertically and spaced apart from the main shaft (41), and thus the traverse shaft (76) can be rotated. The traverse shaft (76) is supported to the lower stationary table (83) by means of a rotating traverse shaft lower housing (69). Similarly, the traverse shaft (76) is supported to the upper platform (37) by means of a rotatable traverse shaft upper support (77).

A traverse device (74) which is known in the art is provided to the traverse shaft (76), the traverse device (74) moving up and down along the axis thereof. There is provided in the traverse arrangement (74) an upper support (75) and a lower support (73) supported to the traverse shaft. These supports are in contact with each other by means of a connection bracket (67). The supports are further in connection though a reversing lever (72) whose circular extension extends outwardly from traverse device (74) and through the rotating pins such that the axes of the supports change when sufficient force is applied on the circular extension of the reversing lever (72) from above or from below.

Between the lower stationary table (83) and the upper platform (37), a top limit (71) and a lower limit (70) are provided to a stem (84) extending adjacent to the traverse shaft (76). During the operation, the traverse device performs a linear motion on the shaft while traverse shaft rotates, because the traverse shaft (76) constantly rotates in the same direction and because the axes of the lower support (73) and the upper support (75) does not coincide with the axis of the traverse shaft (76). This linear motion is maintained until the moment when the circular extension of the reversing lever (72) hits the lower limit (70) or an upper limit (71). When the hit occurs, the axes of the bearings turn into the reverse direction with respect to the axis of the traverse shaft, and in this case, the motion of the traverse arrangement reverses its direction. Thus, twisted yarns received from the reels on the traverse arrangement (74) are wound on the bobbin.

What is claimed is:

1. A yarn twisting machine comprising:

a main shaft into which yarn or yarns are introduced and from which the yarn or the yarns are taken out and the main shaft being driven by a first motor;

a lower twisting disc being in contact with the yarn and the yarns taken out of the main shaft and said lower twisting disc being in communication with said main shaft;

an upper twisting disc having an aperture through which the yarn or the yarns creating a yarn balloon by advancing along the lower twisting disc are fed;

an upper platform situated below said upper twisting disc;

a winding element for winding the yarn or the yarns passing through the upper twisting disc on a bobbin;

a lower stationary table situated above the lower twisting disc; and a second motor for transmitting drive to the winding element through an axial magnetic coupling, comprising a first power transfer device for rotating the upper twisting disc around a shaft axis, the first power transfer device being in communication with the first motor or the second motor and with the upper twisting disc.

2. The machine in accordance with claim 1, when the first power transfer device is in connection with said first motor, further comprising an upper twisting disc drive lower pulley seated on the main shaft, an upper twisting disc drive shaft supported rotatably by supports to the upper platform from one end and to the lower stationary table from the other end, an upper twisting disc drive shaft lower support being in connection with the upper twisting disc drive lower pulley through an upper twisting disc drive lower belt and seated at the bottom end of the upper twisting disc drive shaft, an upper twisting disc drive shaft upper pulley seated at the top end of the upper twisting disc drive shaft, a yarn guide having an aperture therealong;

a movable upper twisting disc lower guide pulley communicating with an upper twisting disc lid; and an upper twisting disc drive upper belt providing drive transfer between the upper twisting disc drive shaft upper pulley and the upper twisting disc lower guide pulley.

3. The machine in accordance with claim 1, further comprising a yarn feeder receiving its motion from said second motor through the first power transfer device, the yarn feeder disposed below said upper platform.

4. The machine in accordance with claim 1, further comprising a propeller reel provided above the upper twisting disc top aperture, the propeller reel freely rotating about a vertical axis of the upper twisting disc top aperture.

5. The machine in accordance with claim 4, further comprising a reel housing supporting the propeller reel in the upper twisting disc top aperture by means of a rotating pin.

6. The machine in accordance with claim 1, further comprising a second power transfer device communicating with said second motor and bobbin for rotating the bobbin.

7. The machine in accordance with claim 6, wherein the second power transfer device comprises an upper drive ring driven by the second motor, a bobbin rotating lower pulley to which motion is transferred by means of a bobbin rotating upper belt, a bobbin rotating belt attached to the bobbin rotating lower pulley, a bobbin rotating pulley to which said bobbin rotating belt transmits motion and supported on the lower stationary table in a movable manner, the bobbin rotating pulley communicating with the bobbin.

8. The machine in accordance with claim 7, further comprising a bobbin fixing lower piece communicating with the bobbin rotating pulley from one end of the bobbin fixing lower piece and with a lower portion of the bobbin from the other end of the bobbin fixing lower piece;

a bobbin fixing upper piece rotatably communicating with a bobbin fixing rod secured to the upper platform from one end of the bobbin fixing upper piece and with an upper portion of the bobbin from the other end of the bobbin fixing upper piece.

9. The machine in accordance with claim 8, further comprising a traverse device providing twisted yarn to said bobbin.

10. The machine in accordance with claim 9, further comprising a third power transfer device communicating with said second motor and traverse device for moving said traverse device.

11. The machine in accordance with claim 10, wherein said third power transfer device comprises an upper drive ring driven by said second motor;

a traverse pulley to which the upper drive ring transmits motion by means of said bobbin rotating upper belt; and a traverse shaft seated at a center of the traverse pulley and rotatably supported on the lower stationary table from a bottom end, and the traverse shaft being rotatably supported on the upper platform from an upper end of the upper platform.

12. The machine in accordance with claim 11, further comprising a twisting disc reel disposed on the circumference of the lower twisting disc;

an upper twisting disc side reel disposed at the circumference of the upper twisting disc;

an upper twisting disc upper reel disposed at a top portion of the upper twisting disc top aperture; and a number of reels of the traverse device.

13. The machine in accordance with claim 12, further comprising an encoder through which yarns are to be twisted and fed from a lower portion of the main shaft, the encoder communicating with a second motor driver circuit, for controlling the speed of the bobbin.

* * * * *